US005233923A

United States Patent [19]

Fuchi

[11] Patent Number: 5,233,923

[45] Date of Patent: Aug. 10, 1993

[54] METHOD AND APPARATUS FOR PRESETTING INK ROLLER CLEANING SPEED

[75] Inventor: Yutaka Fuchi, Ibaraki, Japan

[73] Assignee: Komori Corporation, Japan

[21] Appl. No.: 986,264

[22] Filed: Dec. 7, 1992

[30] Foreign Application Priority Data

Dec. 11, 1991 [JP] Japan ..... 3-350374

[51] Int. Cl.[5] ..... B41F 35/04; B41F 33/16

[52] U.S. Cl. ..... 101/425; 101/484

[58] Field of Search ..... 101/425, 423, 424, 483, 101/484, 349, 350; 118/70, 17, 652; 15/256.51

[56] References Cited

U.S. PATENT DOCUMENTS 3,779,162 12/1973 Ogawa et al. ..... 101/425

4,254,709 3/1981 Arnold ..... 101/425

*Primary Examiner*—J. Reed Fisher

*Attorney, Agent, or Firm*—Blakely, Sokoloff, Taylor & Zafman

[57] ABSTRACT

According to a method and apparatus for presetting an ink roller cleaning speed of the present invention, an operation of a preset switch for setting a speed of a printing press to an ink roller cleaning speed is detected. Whether the speed of said printing press is in a high-speed, low-speed, or slow rotation mode is discriminated when the operation of the preset switch is detected. The speed of the printing press is increased or decreased to the cleaning speed when the speed of the printing press is in the high-speed rotation mode. The speed of the printing press is increased to the cleaning speed when the speed of the printing press is in the low-speed rotation mode. The speed of the printing press is temporarily increased to a speed of the low-speed rotation mode and thereafter increased again to the cleaning speed when the speed of the printing press is in the slow rotation mode.

5 Claims, 1 Drawing Sheet

METHOD AND APPARATUS FOR PRESETTING INK ROLLER CLEANING SPEED

BACKGROUND OF THE INVENTION

The present invention relates to a method and apparatus for presetting an ink roller cleaning speed for automatically setting the current speed of a printing press to a speed preset for ink roller cleaning.

Generally, in a printing press, when the printing color is changed, the ink roller is cleaned. This cleaning operation is performed by setting the speed (rotational speed of the cylinder) of the printing press to a speed appropriate for cleaning, sprinkling a cleaning fluid to several tens of ink rollers, and recovering the waste fluid by a doctor blade set at a predetermined position. In this cleaning operation, if the current speed is higher than the preset speed, the cleaning fluid is scattered around to disable reliable cleaning; if the current speed is lower than the preset speed, the cleaning time is prolonged. Thus, the current speed must be set to a preset speed appropriate for cleaning.

Conventionally, a method is used wherein, upon start of a cleaning operation, the current speed is automatically set to a preset speed appropriate for cleaning in response to a preset switch operation which is done in a high-speed rotation mode among a plurality of rotation modes.

The high-speed rotation mode described above is generally a state of speed within the range of rotational speeds for printing. In the high-speed rotation mode, the current speed can be set to a desired speed in the given range by dial adjustment. The preset speed appropriate for cleaning is determined as one of the states of speed in the high-speed rotation mode.

However, according to this conventional method of presetting the ink roller cleaning speed, the current speed can be automatically set to the preset speed appropriate for cleaning by operating the preset switch only from a high-speed rotation mode having a variable speed. More specifically, a printing press has various speed modes including a low-speed rotation mode and a slow rotation mode, in addition to a high-speed rotation mode. The low-speed rotation mode is a rotation mode for start and end of printing, and its speed is fixed as it is mechanically determined. The slow rotation mode is a rotation mode for printing preparation and printing press warming up, and its speed is also fixed as it is mechanically determined.

Therefore, conventionally, the current speed cannot be automatically set from the low-speed or slow rotation mode having a fixed speed to the preset speed appropriate for cleaning even by operating the preset switch. For this reason, when the cleaning operation is to be performed in the low-speed or slow rotation mode, the printing press must temporarily be set in the high-speed rotation mode, and then the preset switch is operated, resulting in an extra preparation time before start of cleaning. Furthermore, the current rotation mode (slow, low-speed, high-speed) of the printing press must be confirmed and thereafter an operation in accordance with the current rotation mode must be performed, resulting in a cumbersome operation.

SUMMARY OF THE INVENTION

It is an object of the present invention to provide a method and apparatus for presetting an ink roller cleaning speed which can set the speed of a printing press to a cleaning speed within a short period of time regardless of the current rotation mode.

It is another object of the present invention to provide a method and apparatus for presetting an ink roller cleaning speed which realizes a reduction in number of steps of the preparing operation before start of cleaning and simplifies the operation.

In order to achieve the above objects, according to an aspect of the present invention, there is provided a method of presetting an ink roller cleaning speed, comprising the steps of detecting an operation of a preset switch for setting a speed of a printing press to an ink roller cleaning speed, discriminating whether the speed of said printing press is in a high-speed, low-speed, or slow rotation mode when the operation of the preset switch is detected, and increasing or decreasing the speed of the printing press to the cleaning speed when the speed of the printing press is in the high-speed rotation mode, increasing the speed of the printing press to be set to the cleaning speed when the speed of the printing press is in the low-speed rotation mode, and temporarily increasing the speed of the printing press to a speed of the low-speed rotation mode and thereafter increasing the speed of the printing press again to the cleaning speed when the speed of the printing press is in the slow rotation mode.

According to the present invention, according to another aspect of the present invention, there is provided an apparatus for presetting an ink roller cleaning speed, comprising a preset switch for setting the speed of the printing press to the ink roller cleaning speed, mode discriminating means for discriminating whether the speed of the printing press is in the high-speed, low-speed, or slow rotation mode when the preset switch is operated, and speed changing means for increasing or decreasing the speed of the printing press to the cleaning speed when the discrimination result of the mode discriminating means is the high-speed rotation mode, increasing the speed of the printing press to the cleaning speed when the discrimination result of the mode discriminating means is the low-speed rotation mode, and increasing the speed of the printing press to a speed of the low-speed rotation mode and thereafter increasing the speed of the printing press to the cleaning speed when the discrimination result of the mode discriminating means is the slow rotation mode.

DESCRIPTION OF THE PREFERRED EMBODIMENT

A method and apparatus for presetting an ink roller cleaning speed according to the present invention will be described below.

Figure 2:
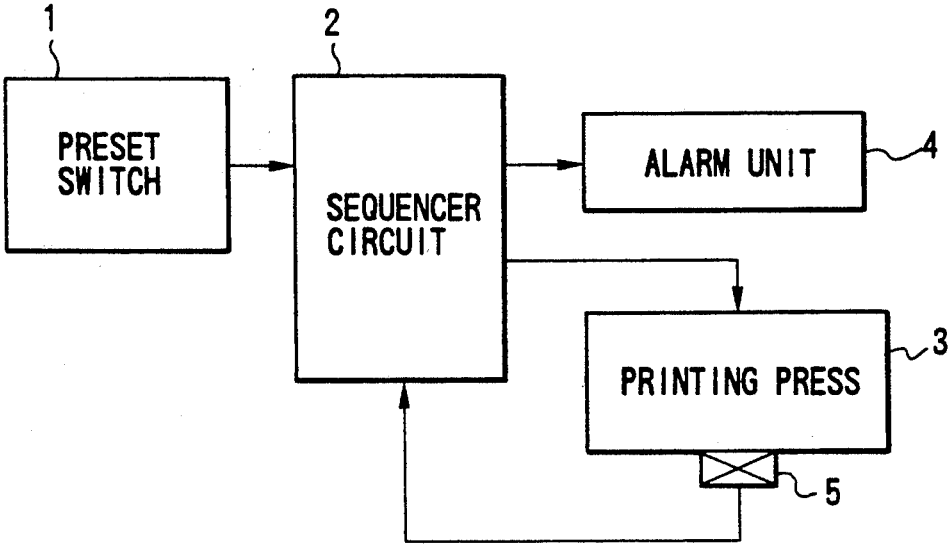
FIG. 2 is a block diagram of an apparatus for presetting an ink roller cleaning speed according an embodiment of the present invention.

FIG. 2 shows an apparatus for presetting an ink roller cleaning speed according to an embodiment of the present invention.

Referring to FIG. 2, reference numeral 1 denotes a preset switch for setting the speed of a printing press 3 to a preset ink roller cleaning speed; 2, a sequencer circuit for receiving an output from the preset switch 1 and performing sequence processing based on, e.g., a program, thereby controlling the speed of the printing press 3; 4, an alarm unit which is activated by the output from the sequencer circuit 2; and 5, a rotary encoder for fetching a pulse signal corresponding to the speed of the printing press 3 during rotation of, e.g., the cylinder.

Figure 1:
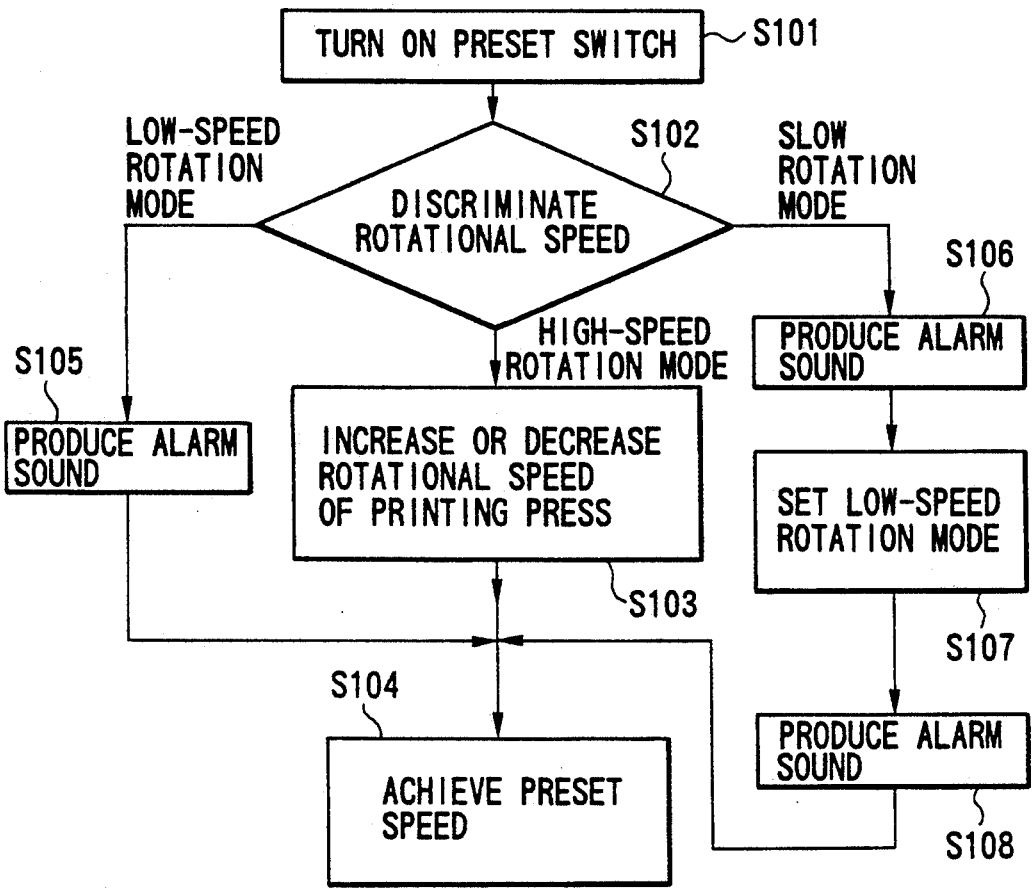
FIG. 1 is a flow chart for explaining the operation of a sequencer circuit shown in FIG. 2.

FIG. 1 is a flow chart for explaining the operation of the sequencer circuit 2. When the preset switch 1 is turned on, the sequencer 2 detects it (S101), reads the current speed of the printing press 3 based on the cycle of the pulse signal supplied from the rotary encoder 5, and discriminates whether the read speed is set in a slow, low-speed, or high-speed rotation mode (S102).

If the speed of the printing press 3 is set in the high-speed rotation mode, the sequencer circuit 2 sends a speed control signal to the printing press 3 to increase or decrease the current speed (S103), thereby setting the speed of the printing press 3 to the preset speed appropriate for cleaning (S104).

If the speed of the printing press 3 is set in the low-speed rotation mode, the sequencer circuit 2 activates the alarm unit 4 to produce an alarm sound (S105), and sends a speed control signal to the printing press 3 to increase the current speed, thereby setting the speed to the preset speed in the high-speed rotation mode appropriate for cleaning (S104).

If the speed of the printing press 3 is set in the slow rotation mode, the sequencer circuit 2 activates the alarm unit 4 to produce an alarm sound (S106), and sends a speed control signal to the printing press 3 to temporarily increase the current speed up to the low-speed rotation mode (S107). Then, when the current speed is increased up to the speed of the low-speed rotation mode, the sequencer circuit 2 activates the alarm unit 4 again to produce an alarm sound (S108), and further increases the speed of the printing press 3 to set it to the preset speed in the high-speed rotation mode appropriate for cleaning (S104).

According to this embodiment, the rotation modes which can conventionally be switched only by a manual operation can be sequentially switched as the speed of the printing press is increased. As a result, the current speed can be automatically set to the preset cleaning speed regardless of the current rotation mode of the printing press when the preset switch is operated.

As has been described above, according to the present invention, the current speed can be automatically set to the preset speed in response to an operation of the preset switch which is done even in the low-speed or slow rotation mode. Therefore, the time required for starting cleaning from the slow rotation mode or the low-speed rotation mode can be shortened when compared to that in the conventional method.

Since the current speed can be automatically set to the preset speed by only an operation of the preset switch regardless of the current rotation mode of the printing press, i.e., the high-speed, low-speed, or slow rotation mode, a cumbersome operation of confirming the rotation mode (slow, low-speed, high-speed) of the printing press and thereafter performing an operation in accordance with the confirmed current rotation mode need not be performed, thereby decreasing the number of operation steps and simplifying the operation by automating it.

What is claimed is:

1. A method of presetting an ink roller cleaning speed, comprising the steps of:

detecting an operation of a preset switch for setting a speed of a printing press to an ink roller cleaning speed;

discriminating whether the speed of said printing press is in a high-speed, low-speed, or slow rotation mode when the operation of said preset switch is detected; and increasing or decreasing the speed of said printing press to the cleaning speed when the speed of said printing press is in the high-speed rotation mode, increasing the speed of said printing press to the cleaning speed when the speed of said printing press is in the low-speed rotation mode, and temporarily increasing the speed of said printing press to a speed of the low-speed rotation mode and thereafter increasing the speed of said printing press again to the cleaning speed when the speed of said printing press is in the slow rotation mode.

2. A method according to claim 1, further comprising the step of producing an alarm sound when the speed of said printing press is increased from the speed in the slow rotation mode to the speed of the low-speed rotation mode and from the speed in the low-speed rotation mode to the cleaning speed.

3. An apparatus for presetting an ink roller cleaning speed, comprising:

a preset switch for setting the speed of a printing press to the ink roller cleaning speed;

mode discriminating means for discriminating whether the speed of said printing press is in the high-speed, low-speed, or slow rotation mode when said preset switch is operated; and speed changing means for increasing or decreasing the speed of said printing press to the cleaning speed when the discrimination result of said mode discriminating means is the high-speed rotation mode, increasing the speed of said printing press to the cleaning speed when the discrimination result of said mode discriminating means is the low-speed rotation mode, and increasing the speed of said printing press to a speed of the low-speed rotation mode and thereafter increasing the speed of said printing press to the cleaning speed when the discrimination result of said mode discriminating means is the slow rotation mode.

4. An apparatus according to claim 3, further comprising alarm producing means for producing an alarm sound when the speed of said printing press is increased from the speed of the slow rotation mode to the speed of the low-speed rotation mode and from the speed of the low-speed rotation mode to the cleaning speed.

5. An apparatus according to claim 3, further comprising a rotary encoder for outputting a pulse signal corresponding to the speed of said printing press, and wherein said mode discriminating means discriminates a type of rotation mode by reading the speed of said printing press based on a period of the pulse signal supplied from said rotary encoder.

* * * * *